US005887400A

United States Patent [19]

Bratek et al.

[11] Patent Number: 5,887,400

[45] Date of Patent: Mar. 30, 1999

[54] EXPANSION CONTROL SYSTEM

[75] Inventors: David J. Bratek, Pendleton; John E. Sobol, Grand Island, both of N.Y.

[73] Assignee: Watson Bowman Acme Corp., Amherst, N.Y.

[21] Appl. No.: 848,860

[22] Filed: May 1, 1997

[51] Int. Cl.[6] ..... E04B 1/686

[52] U.S. Cl. ..... 52/396.03; 52/393; 52/395; 52/396.04; 52/396.06; 52/396.09; 52/573.1

[58] Field of Search ..... 52/393, 395, 396.03, 52/396.04, 396.06, 396.09, 6, 7, 8, 9, 573.1

[56] References Cited

U.S. PATENT DOCUMENTS

| | | | |
|---|---|---|---|
| 4,913,576 | 4/1990 | Grant, Jr. | 52/396.04 X |
| 5,171,100 | 12/1992 | Bergstedt et al. | 52/396.04 X |
| 5,197,250 | 3/1993 | Kramer | 52/396.04 |
| 5,357,727 | 10/1994 | Duckworth et al. | 52/396.04 X |
| 5,365,713 | 11/1994 | Nicholas et al. | 52/396.03 X |
| 5,584,152 | 12/1996 | Baerveldt | 52/396.04 X |

*Primary Examiner*—Carl D. Friedman
*Assistant Examiner*—W. Glen Edwards
*Attorney, Agent, or Firm*—Rudnick & Wolfe; James P. Ryther

[57] ABSTRACT

An expansion joint control system wherein a blockout is formed between structural members such as a floor or wall and a gap allowing for expansion and contraction is defined between the structural members. The blockout defines opposed vertical faces and inwardly extending transverse surfaces with a flexible membrane spanning the distance between vertical faces. A slide plate is attached beneath the center of the membrane. Base members are positioned on the transverse surfaces for supporting the sides of the membrane and are in sliding contact with the slide plate. The slide plate and base members are formed of polymeric materials preferably having thermal expansion characteristics similar to concrete. The system elements occupy a blockout having a depth of one inch or less. The polymeric material can be readily bent on site making the system particularly useful for stadiums, etc. which have continuously changing elevations.

16 Claims, 4 Drawing Sheets

46
20
25
46
20
22
20
26
18
24
30
33
34
32
30
14
10
33
32
25
34
26
28
12
22
20
18
16
25
36

EXPANSION CONTROL SYSTEM

This invention relates to improved expansion joint assemblies designed to bridge spaces between relatively movable structural members such as between two floor sections or between a floor section and a wall. The invention is particularly applicable to areas involving pedestrian traffic.

BACKGROUND OF THE INVENTION

A variety of expansion joint assemblies have been developed. Generally speaking, such assemblies have involved use of expandable membranes which form an upper exposed surface at or near a flush relationship with the adjacent floor. In response to relative movement of the structural members, which may be due to changes in the ambient temperature, the membrane will expand and contract. The side edges of the membrane are attached to the structural members to achieve this result. Beneath the membranes there are provided relatively movable support means for the membranes since they are wide and do not have sufficient strength to support pedestrians and other traffic.

The support means have taken the form of metal plates and other components. Such means often require considerable blockout depth relative to the floor surface. In addition, the designs of the prior art have limited versatility and are therefore often not usable where complex tread-riser directional changes need to be accommodated. Furthermore, such systems often encounter problems with bonding between the structural members and system components due to differences in the coefficient of thermal expansion.

SUMMARY OF THE INVENTION

In accordance with this invention, a unique expansion control system, particularly suited for pedestrian traffic, is provided. The system is especially suited for accommodating low height blockouts and is also adapted for use where complex tread-riser directional changes are encountered.

The system of the invention involves use of a continuous, watertight, membrane seal characterized by high abrasion and UV resistance, and by a flush, non-slip ribbed surface. A high-strength polymer base member is attached at each side of the membrane seal, and these members are bonded to a structural member. The polymer has a coefficient of thermal expansion similar to that of concrete thereby minimizing problems with maintaining this bond.

A high strength polymer slide plate is positioned beneath the membrane seal and spans the gap between the polymer base members. Relative movement between the slide plate, membrane seal and polymer-base members accommodates the expansion and contraction of the structural members.

The system of the invention is applicable to flat work and is also especially versatile when used in connection with expansion control between structural members of stadiums, auditoriums and arenas. In such installations, profile changes for seating, stairs, etc. are designed into the structural members. The membrane seals, polymer base members and slide plates of the invention readily accommodate such tread-riser directional changes. Thus, each component can be readily formed into a variety of shapes to meet the particular variations encountered in such installations.

DESCRIPTION OF THE PREFERRED EMBODIMENTS

Figure 1:
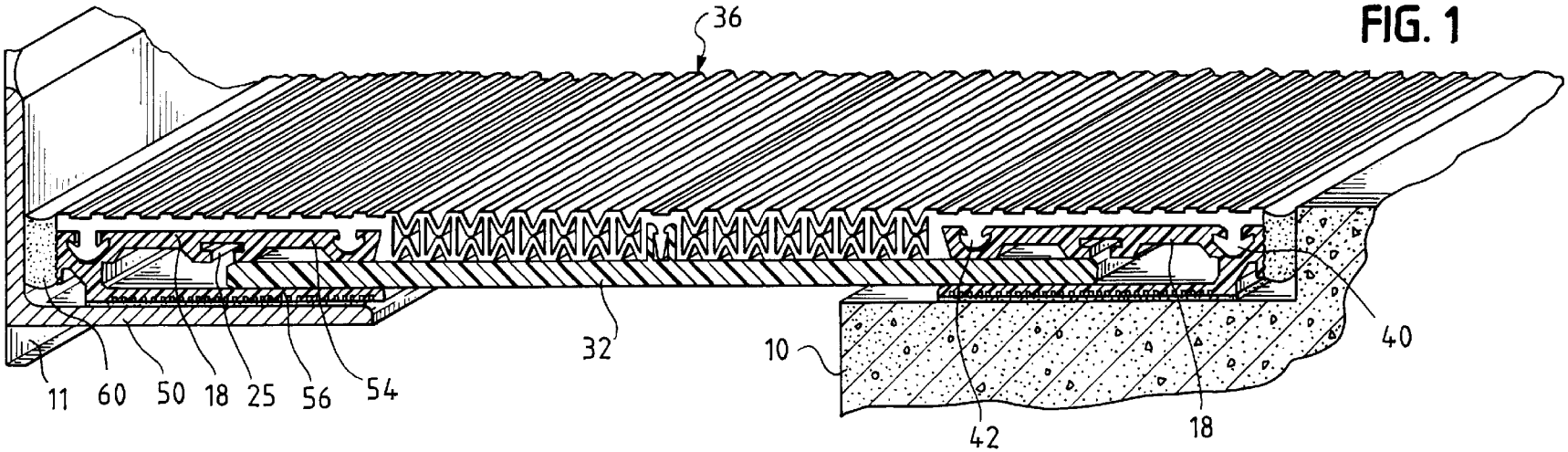
FIG. 1 is a perspective cross-sectional view of the components of the system of the invention installed between structural members including a building wall.
Figure 2:
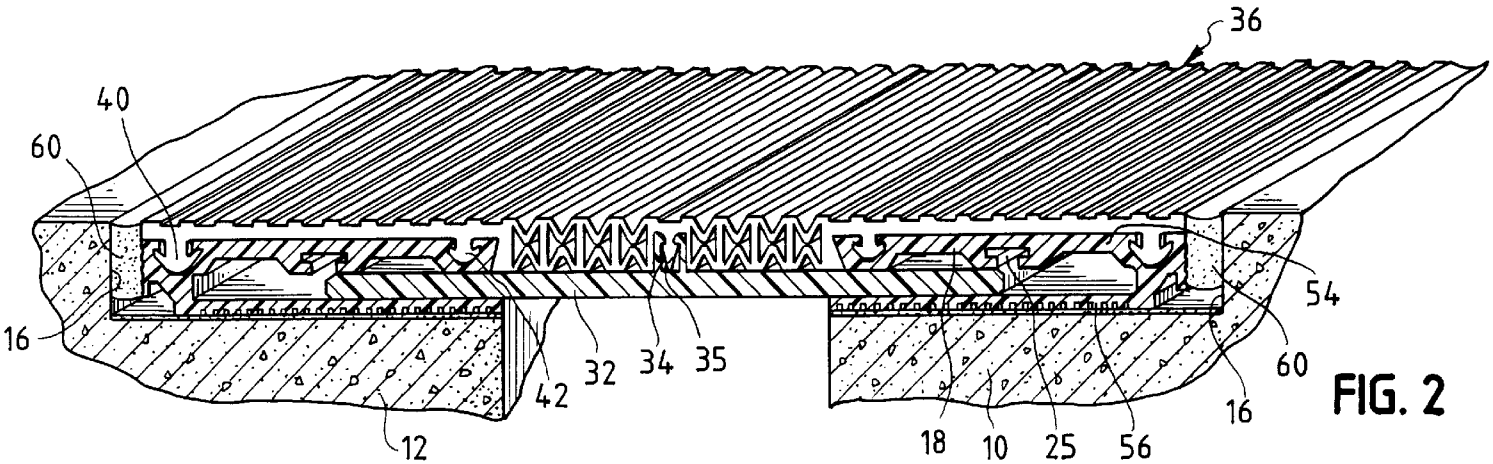
FIG. 2 is a perspective cross-sectional view of the components installed between spaced apart structural members.
Figures 3, 4, 5:
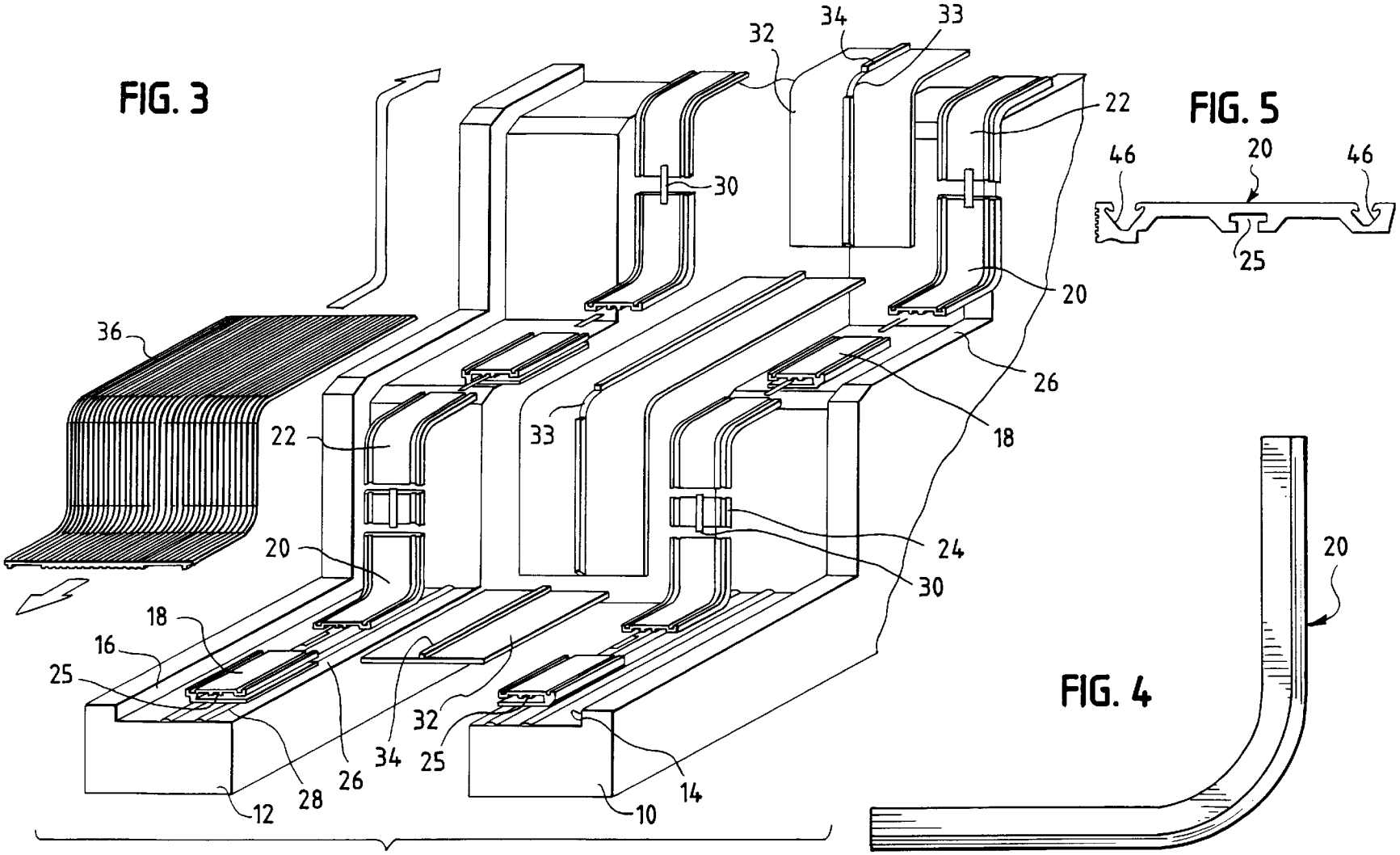
FIG. 3 is a perspective exploded view of the components utilized in the system of the invention.
FIG. 4 is a side elevational view of a bent corner base member utilized in the practice of the invention.
FIG. 5 is an end elevational view of the base member of FIG. 4.
Figure 6:
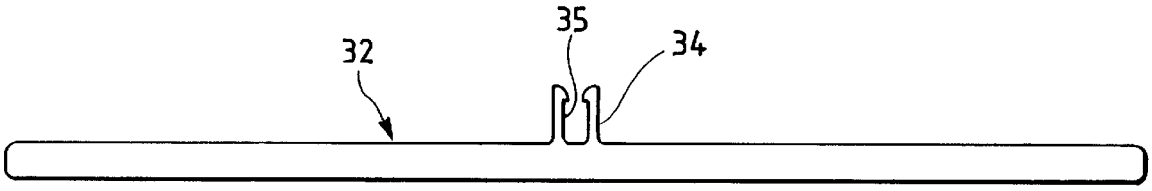
FIG. 6 is an end elevational view of a slide plate used in the system of the invention.
Figure 7:
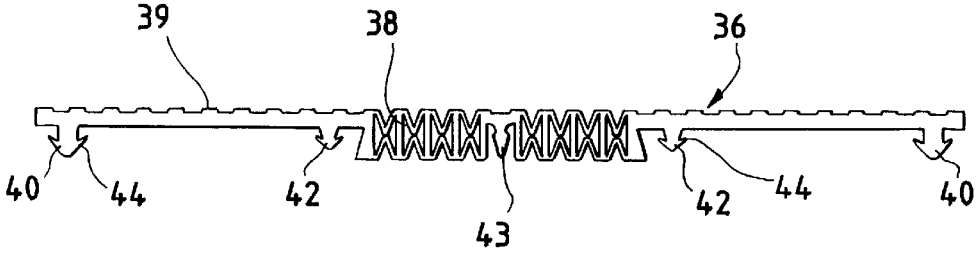
FIG. 7 is an end elevational view of a membrane used in the system of the invention.

FIGS. 1–3 illustrate spaced apart structural members 10 and 12 (or wall 11 in the case of FIG. 1) which may comprise concrete. These structural members take the shape of stairways as are commonly used in buildings such as stadiums, auditoriums and arenas where rows of seating are to be installed at progressively different levels. To accommodate expansion and contraction of the concrete or other material, a gap is formed between the structural members.

The members 10 and 12 define a blockout area between vertical surfaces 14 and 16. Since the system of the invention has a relatively small height, blockout area depth need only be in the order of 1" or less, e.g. ¾" or ⅞".

The system includes base members 18, 20 and 22 formed from a variety of available extruded high strength polymers such as Tuf-Stif 2802 which has a coefficient of thermal expansion of 2.1 (2.1×10–5 in./in./°). This order of magnitude of about 2.0 will match well with concrete. The members 18 are formed flat and are bonded to the surfaces 26 of the members 10 and 12 by means of adhesive beads 28. Members 20, shown in detail in FIGS. 4 and 5 define an inside 90° bend to accommodate the extension of the system from the horizontal upwardly. Members 22 define an outside 90° bend to complete the upward extension and to return to the horizontal.

Short flat base members 24 are positioned between members 20 and 22. Fasteners 30 are provided for splicing the members 20 and 22 as shown at the top of FIG. 3. These fasteners, which are received within passages 25 formed in the base members, are also used to attach the short members 24 to the members 20 and 22. The fasteners preferably comprise stainless steel strips with serrated sides for secure attachment.

Slide plates 32 are located between the base members. These plates are also preferably extruded using high strength polymer such as Tuf-Stif 2802 and each plate defines an upstanding rib 34 defining lug cavity 35 for attachment of the membrane gland 36 of the system. As illustrated, a plurality of slide plates are used and the plates are bent as necessary to conform to the shape of the structural members with which the system is associated.

The membrane gland 36 comprises an extruded profile including a flexible central section defining a plurality of side-by-side channels comprising flexible cells 38. As illustrated, an accordion design is provided in this central section so that each cell can expand and contract in response to movement of structural members. As shown by a comparison of FIGS. 1 and 2, the number of cells may vary depending on the width of gland desired.

The upper surface of the gland defines a non-slip serrated surface 39 for pedestrian safety. This characteristic, as well as the flexibility for movement, is enhanced by using Santoprene, Grade 221/64, a UV resistant elastomer exhibiting a Shore A hardness of about 64, or some similar material.

The gland 36 defines lugs 40 and 42 extending outwardly from its bottom surface. These lugs define shoulders 44 and the lugs are receivable in correspondingly shaped lug cavities 46 defined by the base members. The gland also defines a centrally located lug 43 receivable in lug cavities 35 defined by the slide plates 32.

As shown in FIG. 3, the system of the invention may be used in conjunction with structural members 10 and 12. FIG. 1 illustrates a variation wherein structural angle 50 is used for supporting one side of the system. This arrangement is employed where, for example, the structural member 10 is located in spaced relationship with a wall to which angle 50 is attached. The system of the invention is used to allow for expansion and contraction of the structural member 10 relative to the wall.

In the practice of the invention, the various components are extruded in continuous lengths. The base members and slide plates may be supplied on site in about 10' lengths and the membranes in 100' lengths. The base members 20 and 22 may be cut and then bent to shape using a suitable jig and a hot air gun. These members are preferably assembled on site using butt splice fasteners 30.

Slide plates 32 may also be bent to shape using a hot air gun and gaps 33 are formed in lugs or ribs 34 to facilitate this process. A sub-assembly of the slide plates and base members may then be produced. In this regard, the base members 18 define top and bottom sections 54 and 56 with a space therebetween for receipt of a slide plate. The bottom section 56 is serrated to facilitate bonding of this surface to a structural member by means of an epoxy adhesive or the like as shown at 28 in FIG. 3.

With the subassembly in place, gland 36 is attached by pressing lugs 40 and 42 into the cavities 46 of the base members, and by pressing lug 43 into lug cavity 35 of the slide plate. As illustrated, the gland may be formed by heat application or cut, mitered and re-adhered to include several directional changes in a single piece. After placement, a sealant, as shown at 60, is utilized to fill the space between the faces 14 and 16 of the blockout and the side walls of the respective base member sections. Preferably, the sealant will color match the adjacent structural surface and the elastomeric seal.

FIGS. 8A–D illustrate an alternative form of the invention including membrane gland 60, base member 62 and slide plate 64. In this instance the gland defines four cells 66, and there is no attachment of the gland to the slide plate.

Figure 8A:
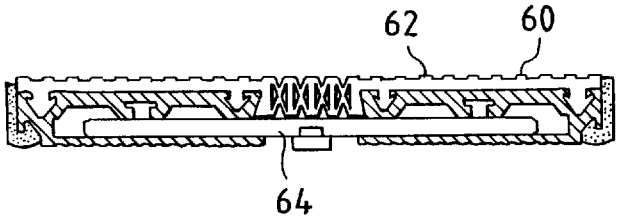
FIG. 8A through 8D illustrate an alternative form of membrane design in various operating stages.
Figure 8B:
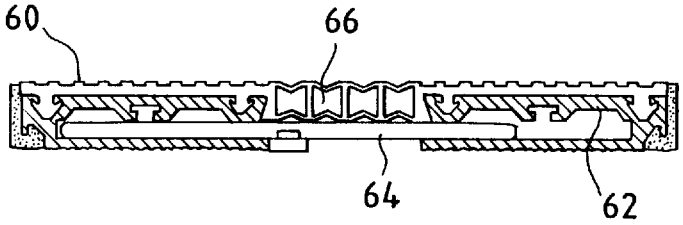
Figure 8C:
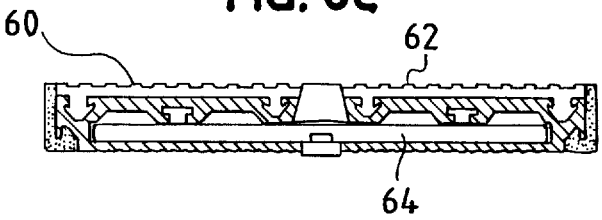
Figure 8D:
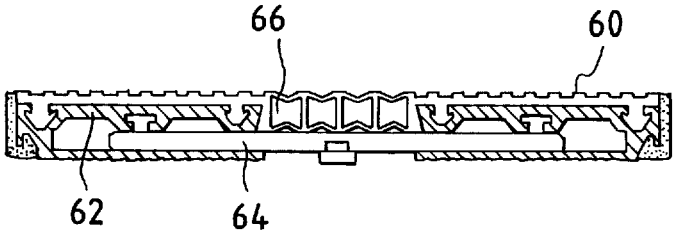

These drawings illustrate the system at mean temperature with the components at mid-range (FIG. 8A). At the maximum allowable opening of the structural members, the cells 66 of the gland are at maximum expansion (FIG. 8B). In this illustration, the slide plate has drifted to a full left position. FIGS. 8C and 8D show the condition when the structural members are at a minimum allowable opening and the maximum allowable opening with the slide plate centered.

The system of the invention combines several features which result in a highly advantageous combination. The system is all non-metallic and the epoxy bonding avoids use of mechanical anchors. The system is watertight and the continuous membrane seal provides a pedestrian friendly, flush, non-slip ribbed surface with high abrasion and UV resistance, all in compliance with ADA guidelines. These features are combined with the low profile blockouts and accommodation for tread riser directional changes as discussed.

It will be understood that various changes and modifications may be made in the system of the invention without departing from the spirit of the invention particularly as defined by the following claims.

That which is claimed:

1. In a building construction having adjacent structural members defining opposing faces, and a longitudinally extending gap defined between said opposing faces, an expansion control system for extending across said longitudinally extending gap defined between said opposing faces of said adjacent structural members, said control system comprising a flexible membrane extending between the structural members, the opposite sides of the membrane being fixed in position relative to said faces of the structural members, and the membrane expanding and contracting in response to movement of said faces toward and away from each other, a base member attached to each of said structural members, each base member supporting one of the sides of the membrane, a slide plate extending beneath said membrane and across said gap for supporting the membrane portion between the sides of the membrane, said base members engaging said slide plate and being free for movement relative to the slide plate as the faces of the structural members move toward and away from each other, and wherein said membrane, said base members and said slide plate are formed of a polymeric material.

2. An expansion control system according to claim 1 wherein said structural members define elevational changes in the same direction as the longitudinal direction of said longitudinally extending gap, and wherein said membrane, said base members, and said slide plate are bent to conform to the changes in elevation.

3. An expansion control system according to claim 2 wherein said base members and slide plate are formed by a polymeric material having a coefficient of thermal expansion in the order of 2.0.

4. An expansion control system according to claim 3 wherein said membrane defines a non-slip serrated upper surface, a central section having a plurality of side-by-side expandable and contractible longitudinal passages, a downwardly and longitudinally extending lug defined by said central section, a longitudinally extending lug-receiving cavity defined by said slide plate for securing said central section in position relative to the slide plate, additional downwardly and longitudinally extending lugs formed in said sides of the membrane, and additional lug-receiving cavities defined by said base members for securing said membrane sides in position relative to said base members.

5. An expansion control system according to claim 4 wherein at least some of the said base members include top sections defining said additional lug receiving cavities, and an integrally formed bottom section spaced downwardly from said top section, said slide plate being confined between top and bottom sections.

6. An expansion joint system according to claim 4 including a longitudinally extending, downwardly depending, passage defined by said base members, and fasteners receivable within passages of adjacent base members for securing the base members in assembly.

7. An expansion joint system according to claim 1 wherein the opposing faces of said structural members extend downwardly from a top surface of the structural members, and transversely extending structural member surfaces extending inwardly from said opposing faces for supporting said base members, said base members being adhesively secured to said transversely extending surfaces.

8. An expansion joint system according to claim 7 wherein the distance from said structural member top surface to a transversely extending surface is no greater than about one inch.

9. In a building construction having adjacent structural members defining opposing faces, and a longitudinally extending gap defined between said opposing faces, a method for installation of an expansion control system used for covering said longitudinally extending gap defined between the opposing faces of said adjacent structural members, the steps comprising providing a flexible membrane defining an exposed upper surface for engagement by pedestrians and other traffic, providing a pair of base members formed of polymeric material, fixing one base member and one side of said membrane to one structural member and the other base member and the other side of said membrane to the other structural membrane, providing a slide plate formed of polymeric material and positioning said slide plate over said gap, said slide plate defining an upper surface supporting the portion of the membrane located between the sides of the membrane, and supporting said base members, the membrane and base members being movable relative to the slide plate in response to movement of said structural members relative to each other.

10. A method according to claim 9, wherein said structural members define portions at different elevations in the same direction as the longitudinal direction of said longitudinally extending gap, and including the steps of shaping said base members and said slide plate to accommodate the changes in elevation.

11. A method according to claim 10 including the steps of supplying said base members and said slide plate as flat pieces, and heating said pieces for shaping the pieces to accommodate the changes in elevation.

12. A method according to claim 11 including the step of forming a blockout in said structural members on opposite sides of said gap, said blockout being formed to a depth of not greater than one inch, and locating said flexible member, said base members and said slide plate in said blockout with said exposed upper surface of said flexible membrane being substantially flush with the upper surface of at least one structural member.

13. A method according to claim 12 including the step of introducing a seal between the side edges of the flexible membrane and adjacent surfaces of the structural members to form a substantially continuous surface between the upper surface of said at least one structural member and the upper surface of the flexible membrane.

14. An expansion control system according to claim 3 wherein said membrane defines a non-slip serrated upper surface, a central section having a plurality of side-by-side expandable and contractible longitudinal passages, downwardly and longitudinally extending lugs formed in said sides of the membrane, and lug-receiving cavities defined by said base members for securing said membrane sides in position relative to said base members.

15. An expansion control system according to claim 14 wherein at least some of the said base members include a top section defining said lug receiving cavities, and an integrally formed bottom section spaced downwardly from said top section, said slide plate being confined between top and bottom sections.

16. An expansion joint system according to claim 14 including a longitudinally extending, downwardly depending, passage defined by said base members, and fasteners receivable within passages of adjacent base members for securing the base members in assembly.

* * * * *